United States Patent [19]

Molitor

[11] 3,975,477

[45] Aug. 17, 1976

[54] METHOD OF INSTALLING THE COPING AND GUTTER OF A RIM FLOW SWIMMING POOL

[76] Inventor: Victor D. Molitor, 2829 S. Santa Fe Drive, Englewood, Colo. 80110

[22] Filed: Oct. 25, 1974

[21] Appl. No.: 517,852

[52] U.S. Cl. ..... 264/35; 52/169 R; 52/742; 249/DIG. 3; 264/40.5

[51] Int. Cl.[2] ..... E04B 1/16

[58] Field of Search ..... 264/31, 34, 35, 40; 52/169, 742; 4/172.18, 172.21

[56] References Cited

UNITED STATES PATENTS

| | | | |
|---|---|---|---|
| 2,729,093 | 1/1956 | Ridley | 264/31 X |
| 3,031,801 | 5/1962 | Leuthesser | 264/31 X |
| 3,753,327 | 8/1973 | Orndoff | 52/742 |

*Primary Examiner*—Robert F. White
*Assistant Examiner*—Thomas P. Pavelko
*Attorney, Agent, or Firm*—Horace B. Van Valkenburgh; Frank C. Lowe

[57] ABSTRACT

The coping and gutter of a rim flow swimming pool are supported by upwardly and downwardly adjustable jacks at spaced positions around the perimeter, with each beneath the lateral center of gravity. A gusset plate extends rearwardly from a reinforcement for the rear wall and may be moved upwardly and downwardly to adjust the transverse level. Each gusset plate, after final adjustment, is attached to a stake. The jacks and the gusset plates are adapted to be embedded in the concrete which forms the wall of the pool, preferably poured in layers by the "Gunite" method, and serve as reinforcements for the concrete.

1 Claim, 7 Drawing Figures

METHOD OF INSTALLING THE COPING AND GUTTER OF A RIM FLOW SWIMMING POOL

This invention relates to a method of installing the coping and gutter of a rim flow swimming pool or the like, particularly the coping and gutter of my copending application Ser. No. 373,143 filed June 25, 1973, now abandoned and entitled "Coping and Gutter for Rim Flow Swimming Pools".

Accuracy in the installation of copings and gutters for swimming pools has been difficult to attain when the coping and/or gutter are made separately and installed before the concrete is poured. Of course, concrete can be poured in forms up to a predetermined height and the bed of concrete leveled off through the use of a transit and the addition of grout to the low spots. The coping and gutter can then be installed, but such installations are quite time consuming and often require level correction after installation. It is significant, of course, that the coping of a rim flow swimming pool must be level all the way around the pool within a fraction of an inch, or water will overflow at the low points.

In my aforesaid copending application Ser. No. 373,143, the coping and gutter are formed of stainless steel and are hollow, being made in sections provided with downwardly and rearwardly extending ribs provided with holes, so that adjacent sections can be bolted together. The bottom rib of the gutter may terminate short of the front edge, so that a form board may engage the underside of the gutter at that point and support the coping and gutter while concrete is being poured. The forms supporting the coping and gutter can, of course, be adjusted by taking height measurements at a number of spaced points, as by utilizing a transit, and adjusting the forms in accordance with the transit sightings. However, the space between the back side of the gutter and the wall of the excavation may vary somewhat and also may be sufficiently narrow that difficulty is encountered in pouring the concrete to completely fill the space beneath the gutter. During such pouring, there is always the chance of the form board supporting the gutter being dislodged and requiring repositioning.

Although the foregoing method has resulted in accurate alignment of the coping, considerable time and effort can be saved by utilizing the "Gunite" method of discharging concrete through a nozzle, with the concrete being sufficiently stiff that it will stand alone but can be worked with a trowel. The aggregate of the "Gunite" concrete is smaller than normal, being on the order of ⅜ inch to 5/16 inch in maximum dimension.

The present invention reduces the time consumed in installing a pool, after the necessary excavation has been dug, from a matter of a month or more to a few days, such as three or four days. The construction of a unitary coping and gutter contributes substantially to saving in time, as does the use of "Gunite" concrete. However, the method and apparatus of this invention also contribute substantially to a saving in time.

The present invention provides a series of adjustable jacks which are attached to the underside of the gutter, preferably at each 10 foot or 12 foot section, at approximately the lateral center of gravity of the section. Through these jacks, the coping and gutter can be adjusted upwardly or downwardly until the desired level is obtained at each jack position. Associated with the jack is a gusset which extends rearwardly from the rear edge of the gutter and is utilized to tip the gutter transversely, in order to level the coping across its top. These gussets are preferably placed at the position of each of the jacks.

Additional novel features will be evident from the following description, taken in conjunction with the accompanying drawings, in which.

Figures 1, 2:
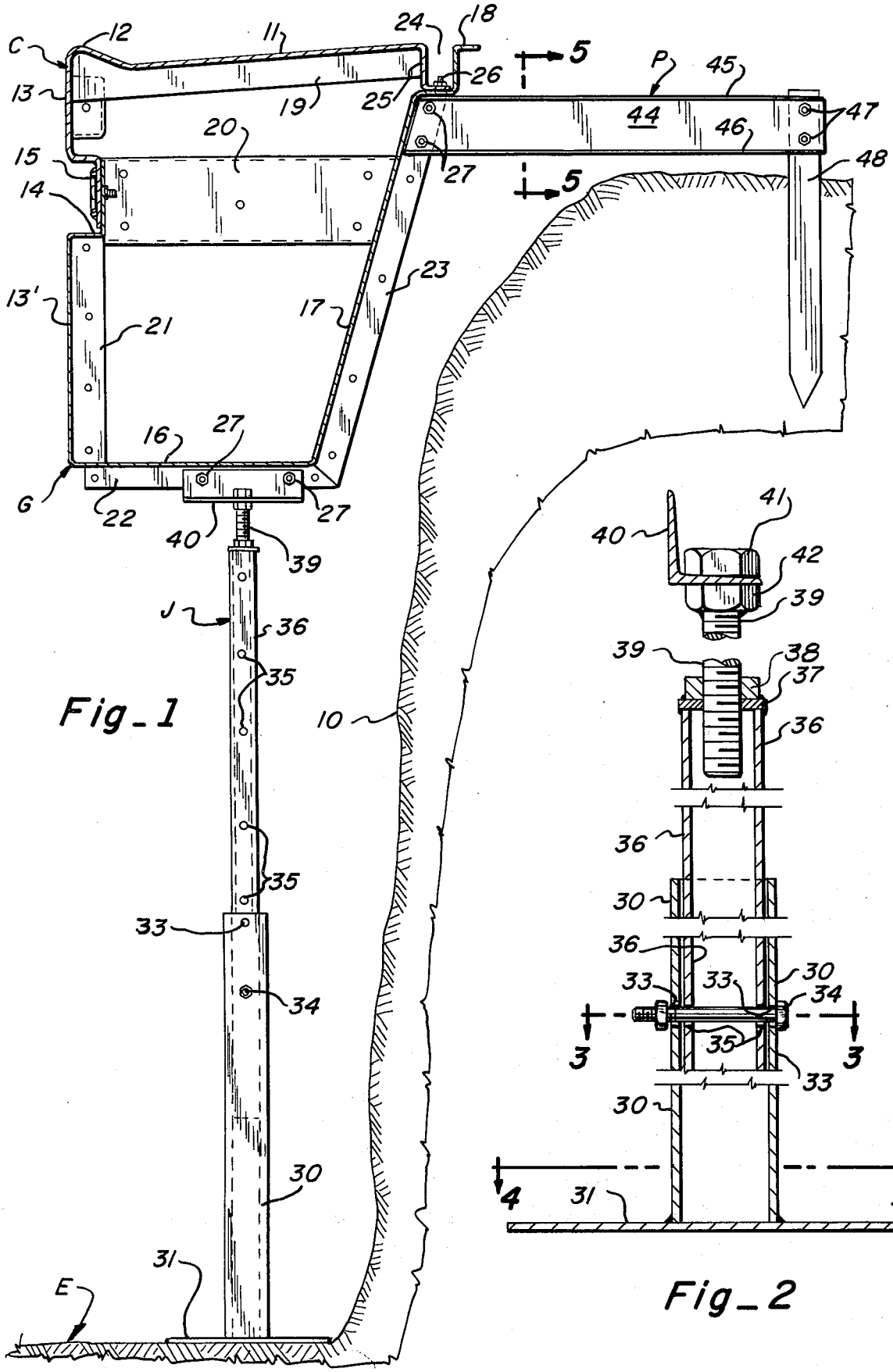
FIG. 1 is a vertical section of a coping and gutter in position for vertical level adjustment by a jack underneath the gutter, and showing also a gusset extending rearwardly from the gutter.
FIG. 2 is an enlarged, condensed longitudinal section of the jack.
Figure 3:
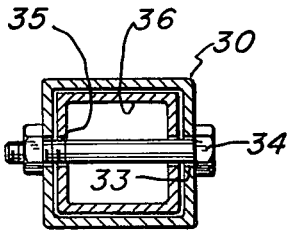
FIG. 3 is a transverse section, taken along line 3—3 of FIG. 2.

As illustrated in FIG. 1, a jack J is attached to the underside of a gutter G to which is attached a coping C. The coping and gutter are supported in approximately the desired position in relation to the wall 10 of an excavation E, which is preferably completed prior to the placement of the coping and gutter. Although reference is made to my copending application Ser. No. 373,413 for other details, it will be noted that the coping and gutter are hollow and preferably formed of stainless steel, the coping having a top plate 11 which is sandblasted and in which a series of slots are punched to permit water to pass downwardly into the gutter G. An upstanding nose 12 provides an upper level to which the pool may be filled, acting to automatically drain off water which moves over the nose, as through wave action, or filling. The front walls 13, 13' form a recess 14 in which may be located adjustment bolts 15 for fine adjustment of the level of nose 12 in relation to the gutter G. The slots (not shown) providing such adjustments are preferably approximately centered when the coping and gutter are installed, saving the adjustment for use after the concrete is set. The gutter G has a bottom 16 and an inclined rear wall 17 which terminates in a rear, angular flange 18. The coping is reinforced by a transverse strut 19 which underlies top plate 11 and the gutter by a transverse strut 20 which extends between the front and rear walls, each at spaced positions along the coping and gutter, respectively. The front of the gutter has a reinforcing angle 21, on the inside, while the bottom and rear are respectively provided with reinforcing angles 22 and 23, on the outside. A drain slot 24 is formed between the rear edge 25 of the coping and the rear flange 18 of the gutter, with edge 25 being provided with spaced drain holes. The rear end of the coping is attached to the gutter by spaced bolts 26.

Each angle 22 and 23 is provided with bolt holes for normal attachment of one section to the next, but particularly adapted to be utilized for the respective attachment of the jack J and gusset plate P, as by bolts 27. The gusset plate P is utilized in tipping the gutter and coping forwardly or rearwardly to level the top of the nose 12 with the rearmost flange 18. In the event that the flange 18 is to be positioned at an elevation above the elevation of the nose 12, this may be taken into account when leveling, as with a transit.

The jack J, as in FIGS. 1–4, may be provided with an outer tube 30, rectangular as shown or circular if desired, the lower end of which is welded to a base plate 31 adapted to rest on the bottom of the excavation and to be attached thereto, as through metal stakes driven through one or more holes 32. The outer tube 30 is provided with pairs of opposed holes 33 adjacent and spaced from the upper end adapted to accommodate a bolt 34 extending also through a selected pair of holes 35 in an inner tube 36 which preferably has the same configuration as the outer tube 30 and of a size to fit within the outer tube but slide readily therein. The pairs of holes 35 in inner tube 36 are spaced an appropriate distance apart, such as 6 inches, so that a variety of positions of the inner tube 36 may be selected. A top plate 37 is welded to the top of inner tube 36, while a fixed nut 38 is welded to the top plate. Top plate 37 has a hole through which a fully threaded bolt 39 extends for engagement with nut 38, while the length of bolt 38 is greater than the distance between the pairs of holes 35, so that any incremental adjustment may be made, between the lowest position of the inner tube 36 and the uppermost position thereof. An angle 40, which is provided with a pair of holes in its upper leg for bolts 26 and in its lower leg with a hole through which bolt 39 extends, is adjusted upwardly and downwardly by turning the head 41 of bolt 39, so as to move it upwardly and downwardly in fixed nut 38. Angle 40 rests on a nut 42 welded to bolt 39 in a position such that the bolt may be readily turned by a wrench or the like but will stay in an adjusted position. As will be evident, the bolt 34 is placed in the appropriate hole 35 of the inner tube when the jack is first installed, so that the bolt 39 may be utilized for additional adjustment later.

Figure 5:
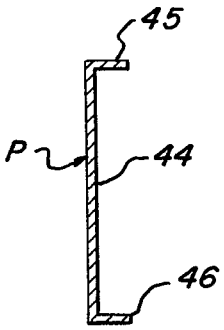
FIG. 5 is a cross section of the gusset, on a slightly enlarged scale and taken along line 5—5 of FIG. 1.

The gusset plate P may, as indicated, be used to tip the coping toward or away from the pool and thus maintain the top of the nose 12 and the top of the rear flange 18 level with each other, or in a level condition considering any necessary difference in elevation between the two, as when an elevation of the deck beyond drain slot 24, as of 2 inches or 3 inches, is required by regulation or statute. As in FIG. 5, a web 44 of gusset plate P may be provided with upper and lower stiffening flanges 45 and 46, respectively, while web 44 is also provided with appropriate holes placed in slanting position, as in FIG. 1, to accommodate bolts 26. Web 44 is further provided with smaller holes by which the rear edge of the gusset plate may be attached, as by nails 47, to a stake 48 which is driven into the earth at an appropriate place. As will be evident, the operator refrains from driving in nails 47 until the adjacent portion of the coping and gutter have been elevated to the proper level and also leveled off.

Figure 6:
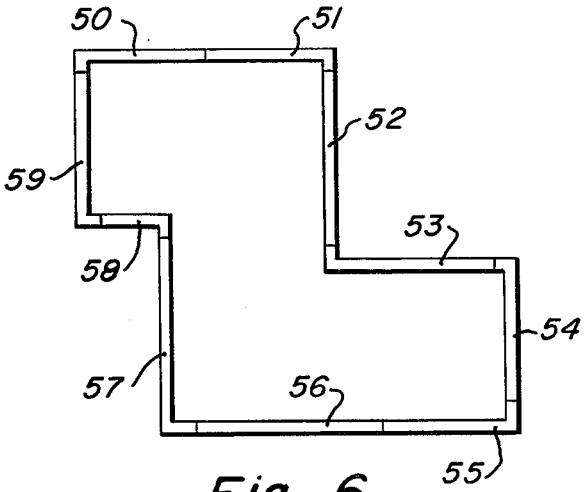
FIG. 6 is an outline of a pool to the installation of which the principles of this invention have been applied, with an indication of a preferred order of installation of assembled sections of the coping and gutter.
Figure 4:
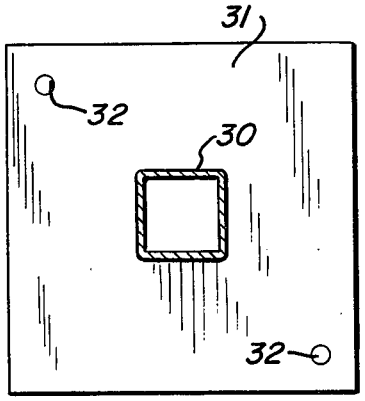
FIG. 4 is a cross section, taken along line 4—4 of FIG. 2 but on a reduced scale.

In installing the coping and gutter in a swimming pool of the configuration shown in FIG. 6, a portion 50 containing, for instance, one corner section and two 12 foot sections may be installed first, with the portion 51 being installed next by attachment to portion 50. Similarly, the sections 52, 53, 54, 55, 56 and 57 are attached in sequence to the prior section, adjusted to the correct height and leveled off. Most of the sections include a corner, which is helpful in maintaining alignment as the installation proceeds. Following the installation of portion 57, portions 58 and 59 are installed in turn. Preferably, the portion 59 is first connected to the initial portion 50, then to the last previous portion 58. The length of the portions into which the perimeter of the gutter and coping are divided will depend on the length which the shipping facility will accommodate.

By installing the coping and gutter portions in sequence, a single transit setting may be utilized, with each of the sections being surveyed in turn. If desired, a level may be placed across the nose 12 and the upper rear flange 18, so that the gusset plate P may be utilized to level the top of the coping without the necessity for transit sightings. If the top of rear flange 18 is to be 2 inches higher than the nose 12, for instance, a two inch block may be placed on nose 12 while using the level. Of course, after the top of the coping has been leveled, it may be necessary to sight with a transit again, to determine whether the adjustment has changed the elevation of nose 12.

After the coping and gutter sections have been installed and connected together around the pool, the concrete may be laid in place by the "Gunite" method, by which the concrete is merely directed out of a nozzle into the desired place. This concrete is sufficiently stiff that it will stand where poured, but can still be worked by a trowel or the like to smooth off the front edge of the concrete below the gutter, for instance. Additional reinforcement should, of course, be placed in the excavation E, such as behind jack J or in front of the same, or to each side, as required. It will be noted that installation reinforcement may be attached to the depending flanges 22 or 23, as at holes at which the flanges of two abutting sections are not otherwise attached.

The concrete is preferably poured in layers, such as one foot to 1½ feet thick, as with each layer extending completely around the pool. Of course, one layer should be covered by the next layer before the first layer has set, so that the two layers will fuse together, as it were, and there will be no ultimate line of demarcation between various layers.

After the "Gunite" concrete laid by the nozzle has reached the bottom of the gutter G, the remainder of the concrete may be laid from the rear side of the gutter. If there is any possibility of a cave-in during pouring of the concrete, a conventional form may be set up adjacent the earth E. If it appears undesirable to embed the stake in the concrete, each stake may be removed, in turn, as the concrete approaches it. At that time, of course, there should be sufficient concrete abutting against the bottom and the rear wall of the gutter G, as well as engulfing the jack J and at least a portion of gusset plate P, to maintain the gutter in its desired position.

Figure 7:
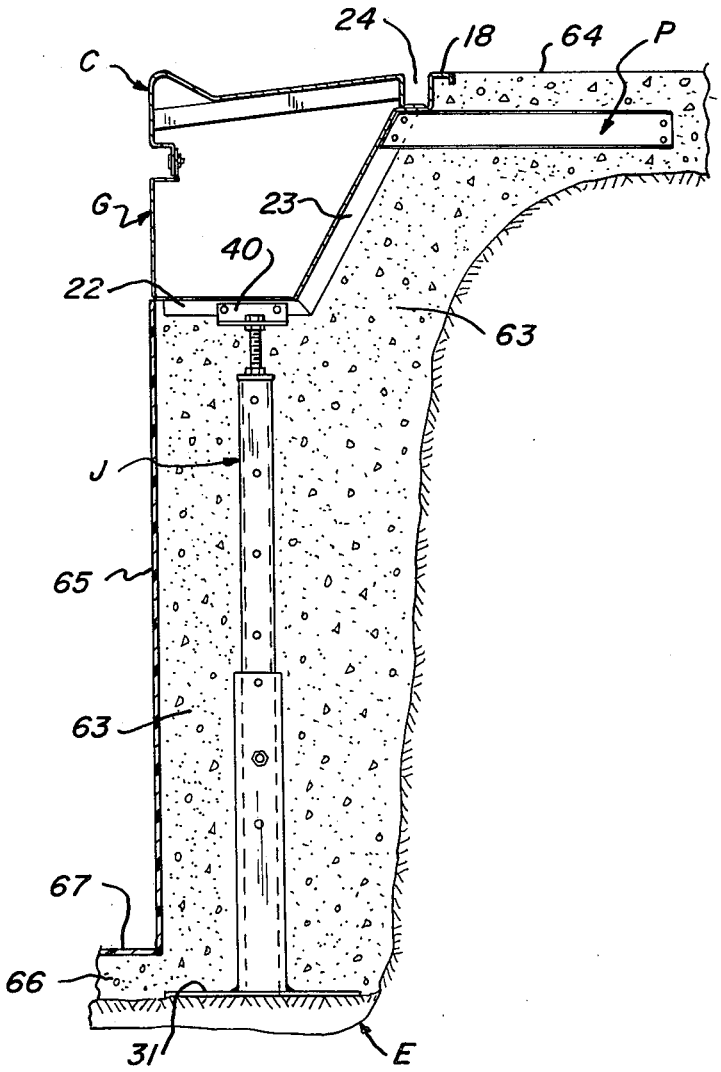
FIG. 7 is a vertical section similar to FIG. 1, but showing the concrete poured and the jack and gusset embedded in the concrete, for use as reinforcements.

As illustrated in FIG. 7, both the jack J and the gusset plate P are ultimately embedded in the concrete 63 which may be poured rearwardly from the rear edge of the upper flange 18, which may also be used to strike the top surface of the concrete rearwardly thereof. If desired, the "Gunite" concrete may be laid up to the top of gusset plate P, so that the "Gunite" concrete, when set, will provide a base for additional concrete which may be laid in the more usual manner to form a deck 64. The inner surface of the concrete may be provided with a waterproof, protective plastic layer 65, as of an epoxy resin, which also minimizes injury to swimmers who may abut or slide along the surface. An extension 66 of the concrete may be laid on the bottom of the excavation to form the bottom of the pool, also provided with a plastic layer 67.

In the event that the concrete is to be poured by a more conventional method, forms may be set up beneath the front edge of the gutter G and, if necessary, adjacent the earth E Although a preferred embodiment of this invention has been illustrated and described, it will be understood that other embodiments may exist and that various changes may be made, without departing from the spirit and scope of this invention.

What is claimed is:

1. In a method of installing a coping and gutter assembly of a rim flow swimming pool having an upper front nose which determines the level of water in the pool and means for draining, into said gutter, water which overflows said nose, the steps including:

supporting said assembly, at spaced positions on the underside thereof, in an excavation for said swimming pool by adjustable supporting devices each placed below the approximate lateral center of gravity thereof;

determining the elevation of an upper edge of said assembly at points generally above said supporting devices;

adjusting said supporting devices in order to obtain a desired level;

providing rearwardly extending gussets attached to the rear side of said assembly for tipping said assembly laterally at said supporting devices;

tipping said assembly about said supporting devices to produce a desired elevation of the rear of said assembly relative to the front thereof;

locking said gussets in said adjusted positions;

pouring concrete or the like to form a wall of said swimming pool; and embedding said supporting devices and said gussets in said concrete.

* * * * *

UNITED STATES PATENT AND TRADEMARK OFFICE

CERTIFICATE OF CORRECTION

PATENT NO. : 3,975,477

DATED : August 17, 1976

INVENTOR(S) : Victor D. Molitor

It is certified that error appears in the above-identified patent and that said Letters Patent are hereby corrected as shown below:

Column 1, line 9, "now abandoned" should be cancelled.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*